United States Patent [19]

Vandeweghe et al.

[11] Patent Number: 5,025,838

[45] Date of Patent: Jun. 25, 1991

[54] SUPPORTING MECHANISM FOR THE BACK REST IN A WEAVING MACHINE

[75] Inventors: Michel Vandeweghe, Wijtschate-Heuvelland; Bart Lefever, Ypres; Stefaan Vandersyppe, Wervik, all of Belgium

[73] Assignee: Picanol N.V., Ypres, Belgium

[21] Appl. No.: 552,895

[22] Filed: Jul. 16, 1990

[30] Foreign Application Priority Data

Jul. 17, 1989 [BE] Belgium ..... 8900778
Jun. 21, 1990 [EP] European Pat. Off. ..... 908700095.8

[51] Int. Cl.[5] ..... D03D 49/22
[52] U.S. Cl. ..... 139/114; 267/160
[58] Field of Search ..... 267/158, 160; 139/114, 139/115; 248/576, 599, 602, 605, 611, 629

[56] References Cited

U.S. PATENT DOCUMENTS

| | | | |
|---|---|---|---|
| 2,240,646 | 5/1941 | Hagen | 139/114 |
| 2,989,298 | 6/1961 | Ljungstrom | 267/160 |
| 4,240,471 | 12/1980 | Rotrekl et al. | 139/114 |
| 4,387,743 | 6/1983 | Suzuki et al. | 139/115 X |
| 4,483,372 | 11/1984 | Demuth | 139/114 |

FOREIGN PATENT DOCUMENTS 2119285 8/1972 France .

*Primary Examiner*—Andrew M. Falik
*Attorney, Agent, or Firm*—Bacon & Thomas

[57] ABSTRACT

Supporting mechanism for the back rest in a waving machine, consisting of at least two supports which support the back rest at its respective ends, characterized in that each support (11) essentially consists of at least two leaf springs (12, 13) mounted next to one another and attached at one of their ends (14, 15) to one another and to the weaving machine, and which at their opposite ends (16, 17) are also connected with one another in order to support the back rest (3).

18 Claims, 4 Drawing Sheets

Fig.1
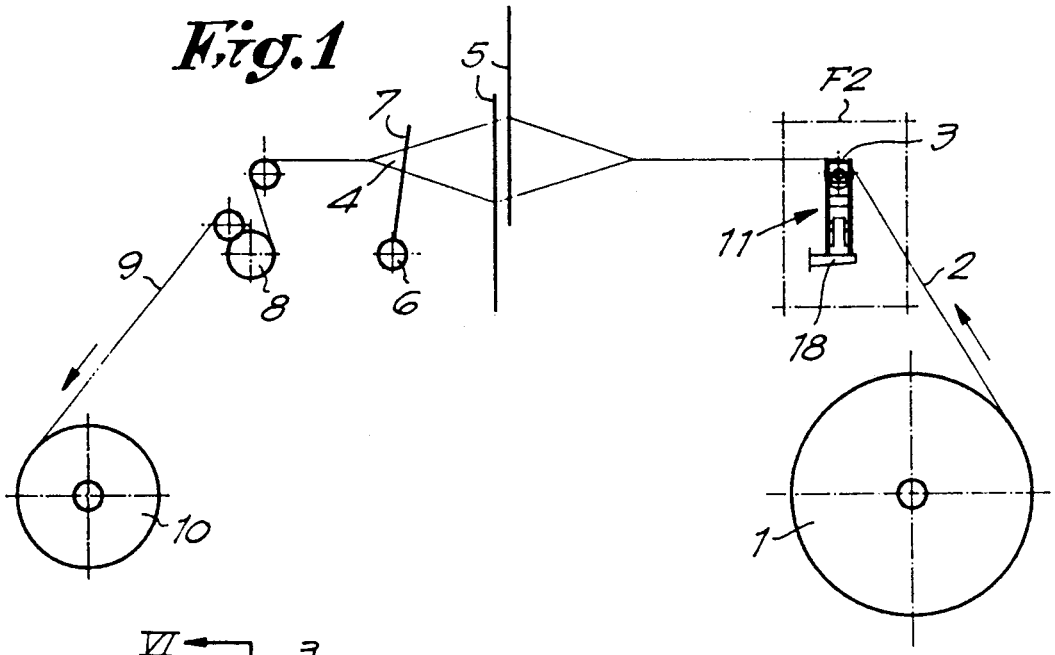
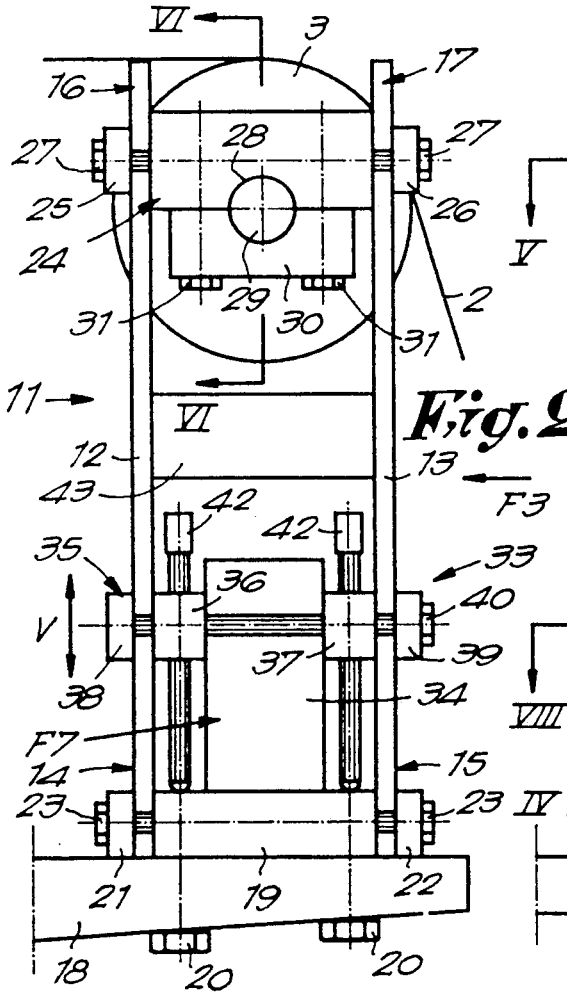
Fig.2
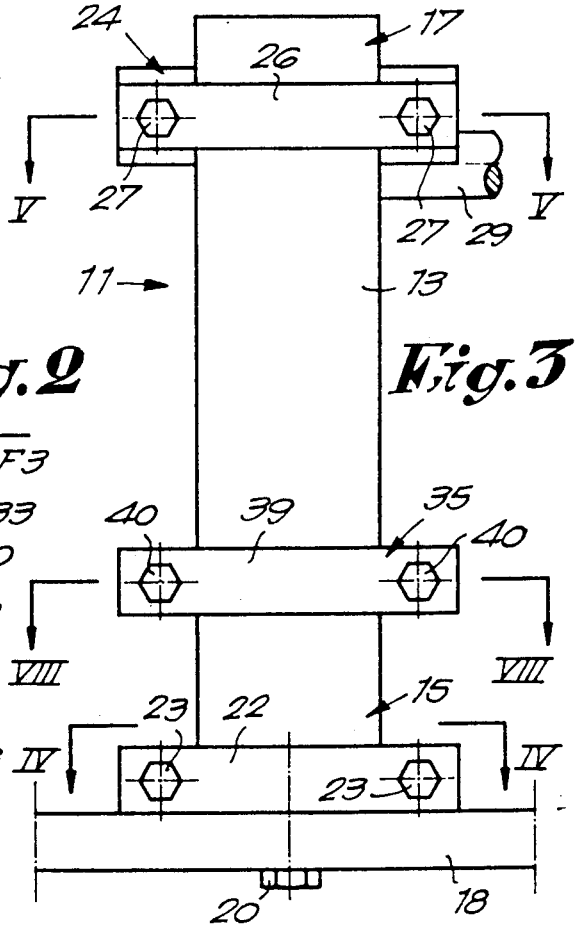
Fig.3

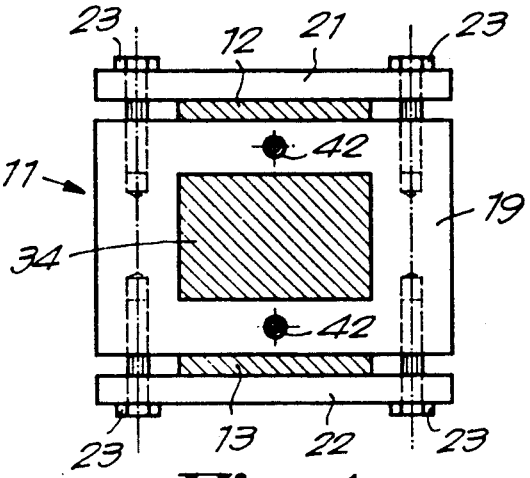
Fig. 4
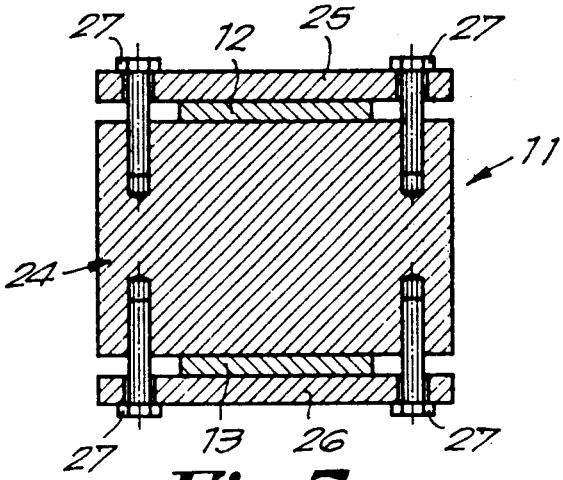
Fig. 5
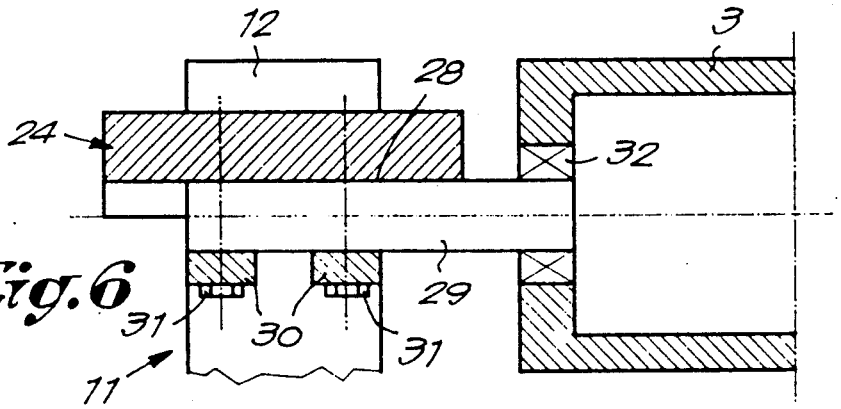
Fig. 6
Fig. 7
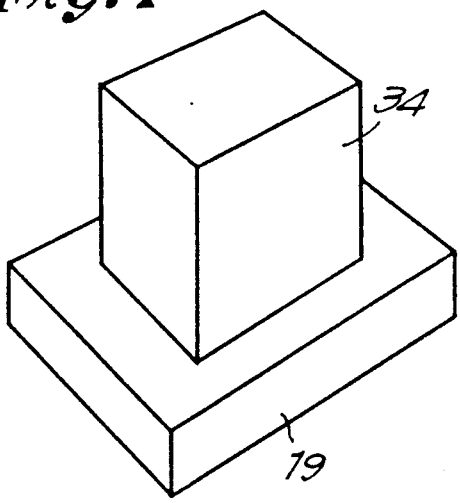
Fig. 8
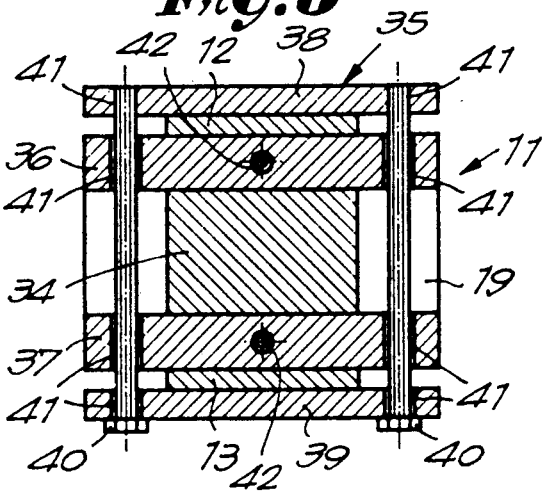

SUPPORTING MECHANISM FOR THE BACK REST IN A WEAVING MACHINE

The present invention concerns a supporting mechanism for the back rest in a weaving machine.

It is known that the supporting mechanisms for the back rest in a weaving machine essentially consist of two levers which support the back rest at one of their ends, and are charged by means of a spring and/or a damper at their other end.

This known construction has the disadvantage that it is relatively expensive, as each lever requires a shaft, a bearing and joints for the spring and the damper. Further, a special dust-proof bearing must be applied, such that the good operation cannot be impeded by the penetration of weaving dust.

Also, the adjustment of a back rest mounted between two levers is rather difficult.

These known supporting mechanisms are also difficult to combine with devices which impose a periodical motion on the back rest, better known as "easing motion".

The present invention concerns a supporting mechanism for the back rest which does not have the above-mentioned disadvantages, and has the advantage of a simple construction and mounting.

To this end, the invention concerns a supporting mechanism for the back rest in a weaving machine, consisting of at least two supports which support the back rest at its respective ends, characterized in that each support essentially consists of at least two leaf springs mounted next to one another, which at one of their ends are attached to one another and to the weaving machine, and which are also connected with one another at their opposite ends in order to support the back rest.

In a preferred embodiment, adjusting means are also provided to modify the effective length of the leaf springs.

The supporting mechanism can be arranged at various angles. It can be fixed to the frame of the weaving machine, or according to a variant on a device which performs a periodical motion to and fro.

In order to better explain the characteristics of the invention, by way of example only and without being limitative in any way, the following preferred embodiments are described with reference to the accompanying drawings, where:

FIG. 1 shows a schematic representation of a weaving machine provided with a supporting mechanism according to the invention;

FIG. 2 shows a view of the part indicated in FIG. 1 by F2, to a greater scale;

FIG. 3 shows a view according to arrow F3 in FIG. 2;

FIGS. 4 and 5 show cross-sections according to lines IV—IV and V—V respectively in FIG. 3;

FIG. 6 shows a cross-section according to line VI—VI in FIG. 2;

FIG. 7 shows the part indicated in FIG. 2 by F7 in perspective;

FIG. 8 shows a cross-section according to line VIII—VIII in FIG. 3.

Figure 9:
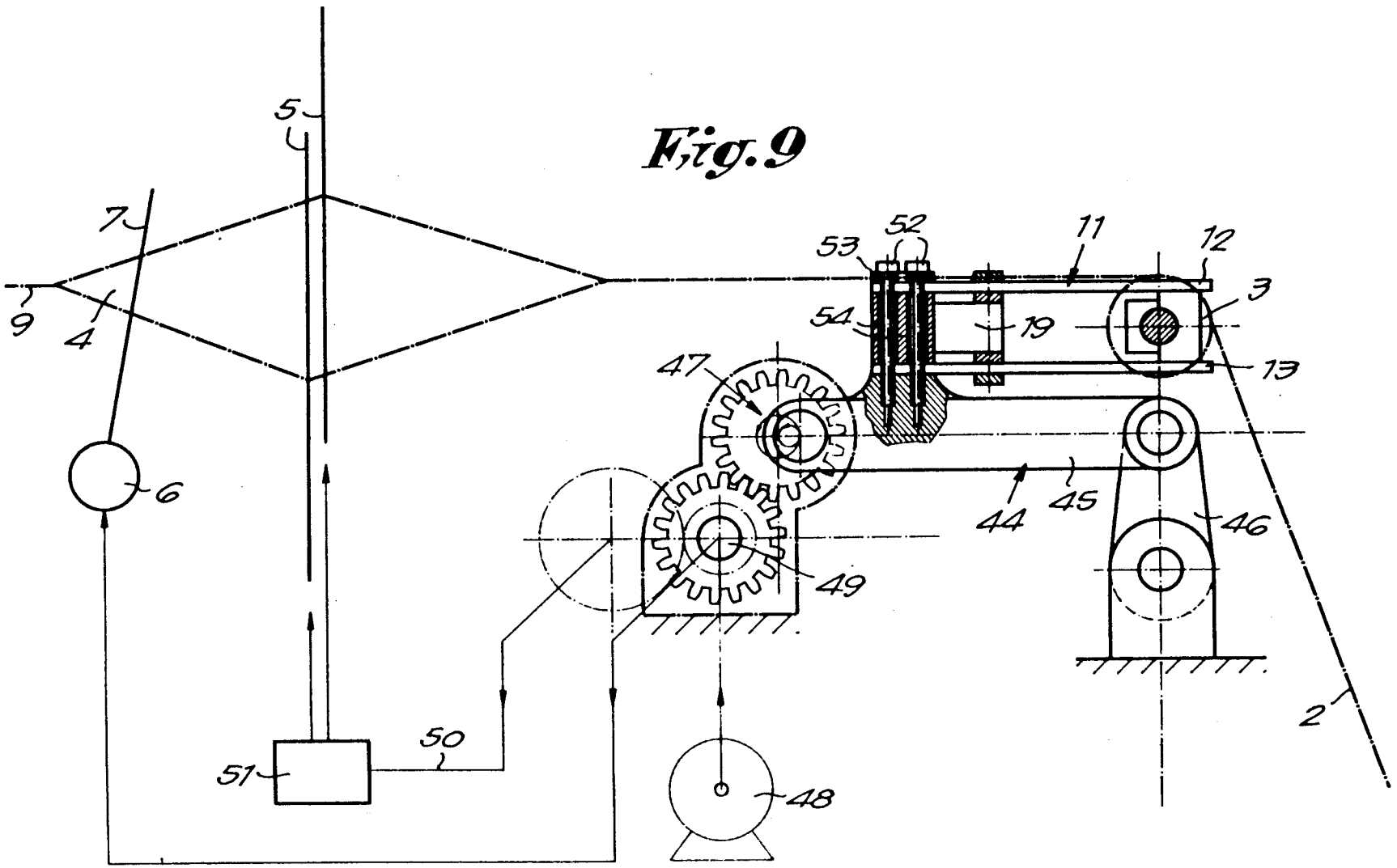
FIGS. 9 and 10 show two special embodiments of the supporting mechanism according to the invention.

In order to situate the invention, FIG. 1 shows a schematic representation of a weaving machine, in which the warp beam 1, the warp 2, the back rest 3 over which the warp 2 is bent as known, the shed 4, the harnesses 5, the sley 6 with the reed 7, the sand roller 8, the formed cloth 9 and the cloth roll 10 are indicated.

The present invention is special in that the supporting mechanism which supports the back rest 3 consists of at least two supports 11 which support the back rest 3 at its respective ends, characterized in that each support 11, as indicated in FIGS. 2 to 8, essentially consist of at least two leaf springs 12 and 13 mounted next to one another and fixed to one another at one of their ends 14 and 15 and to the weaving machine, and which are also attached to one another at their opposite ends 16 and 17 in order to support the back rest 3 there, whereby the leaf springs 12 and 13 are mounted such that they can bend according to the sense of the motion of the warp 2.

FIGS. 1 to 3 show an embodiment whereby the supports 11 are fixed to the frame 18 of the weaving machine.

The leaf springs 12 and 13 are preferably mounted in parallel next to one another and are only connected to the other parts by clamping, such that the preferably rectangular leaf springs need not be drilled through.

To this end, the leaf springs 12 and 13 are clamped at their ends 14 and 15 between, on the one hand, a support 19 which, for example by means of bolts 20, is mounted on the frame 18, and on the other hand, clamping parts 21 and 22 which can be tightened by means of screwing means such as bolts 23, clutching in the support 19. As shown in FIG. 4, the support 19 and the clamping parts 21 and 22 are wider than the leaf springs 12 and 13, such that the bolts 23 pass along the leaf springs 12 and 13.

At their opposite ends 16 and 17, the leaf springs 12 and 13 are connected with one another by means of an element 24 mounted between them, which is held in place by means of clamping parts 25 and 26, which are applied along the sides of the leaf springs 12 and 13 pointing away from each other, and which are tightened by means of screwing means such as bolts 27, whereby, as shown in FIG. 5, these bolts 27 also pass freely along the leaf springs 12 and 13.

The elements 24 of the respective supports 11 each have a seating 28 in which the back rest 3 can be mounted at its shaft ends 29, as shown in FIGS. 2 to 6. The shaft ends 29 are preferably clamped in their seatings 28 by means of at least one clamping element and preferably two clamping elements 30 and by means of bolts 31. As is known, the back rest 3 is a hollow tube which at each end can rotate over the shaft end 29 concerned by means of bearings 32.

Each support 11 preferably has adjusting means 33 to modify the effective length of the leaf springs 12 and 13, in order to make the supports 11 either more or less rigid.

As indicated in FIG. 2, these adjusting means 33 are preferably formed by a support 34 mounted between the leaf springs 12 and 13 and by clamping means 35 which can be adjusted in the lengthwise direction of the leaf springs 12 and 13, and by which the leaf springs 12 and 13 can be clamped at any height. The central support 34 shows a width smaller than the mutual distance between the two leaf springs 12 and 13 and preferably forms a whole with the above-mentioned support 19, as shown in FIG. 7. The clamping means 35 are preferably composed of intermediate parts 36 and 37 which are movable between the leaf springs 12 and 13 and the support 34, clamping parts 38 and 39 which can be applied along the sides of the leaf springs 12 and 13 pointing away from each other, and screwing means such as bolts 40 to tighten the intermediate parts 36 and 37, the clamping parts 38 and 39 and the leaf springs 12 and 13 round the support 34 at the desired height.

The intermediate parts 36 and 37, as well as the clamping parts 38 and 39 are preferably made in the form of laths whose length is greater than the width of the leaf springs 12 and 13. The intermediate parts 36 and 37 and the clamping parts 38 and 39 have drillings 41 which allow the above-mentioned bolts 40 to be applied on either side of the support 34 and of the leaf springs 12 and 13, whereby said bolts 40 pass freely through the intermediate parts 36 and 37 and the clamping part 39, yet can be screwed into the clamping part 38.

In order to facilitate the setting of the clamping means 35, they can be provided with set screws 42, which, as shown in FIGS. 2 to 8, can be screwed through the intermediate parts 36 and 37 and further rest freely on the support 19. After the clamping means 35 have been loosened, their height can be modified by screwing out more or less the set screws 42. By the setting of the adjusting means 33, the effective length of the leaf springs 12 and 13 can be modified in a simple way, such that the springy operation of the leaf springs 12 and 13 is set. This allows the intensity of the springy operation of the supports 11 which support the back rest 3 to be set in a simple way, depending on the desired tension in the warp 2.

It is clear that this flexible supporting mechanism can also be equipped with means for damping the motion. According to the invention, these means preferably consist of an element 43 which is attached between the leaf springs 12 and 13, for example of a block made from synthetic material and glued between said leaf springs 12 and 13.

The supports 11 are preferably mounted either essentially vertically or essentially horizontally, as shown in FIGS. 1 and 9 respectively.

As shown in FIG. 9, the supports 11 can also be mounted on the weaving machine by means of a supporting means 44 which imposes on the back rest 3 a periodical motion to and fro in correspondence with the harness motion, in order to keep the tension in the warp 2 practically constant despite the opening and closing of the shed 4. Such supporting means 44, better known as "easing motion", are already sufficiently known and are essentially formed by a number of arms 45 and 46 which are moved by means of an eccentric 47 or similar. This eccentric 47 is coupled to the main shaft 49 driven by the main drive motor 48, such that it is driven at double the speed of the drive shaft 50 to which the harness drive mechanism 51 is coupled. The supports 11 can hereby be attached, in a simple way and similar to the way described in FIG. 2, to the arms 45 of the supporting means 44 by means of screwing means, such as bolts 52, and a clamping part 53. For this purpose, the support 19 can be provided with drillings 54 which allow the application of the above-mentioned bolts 52.

Figure 10:
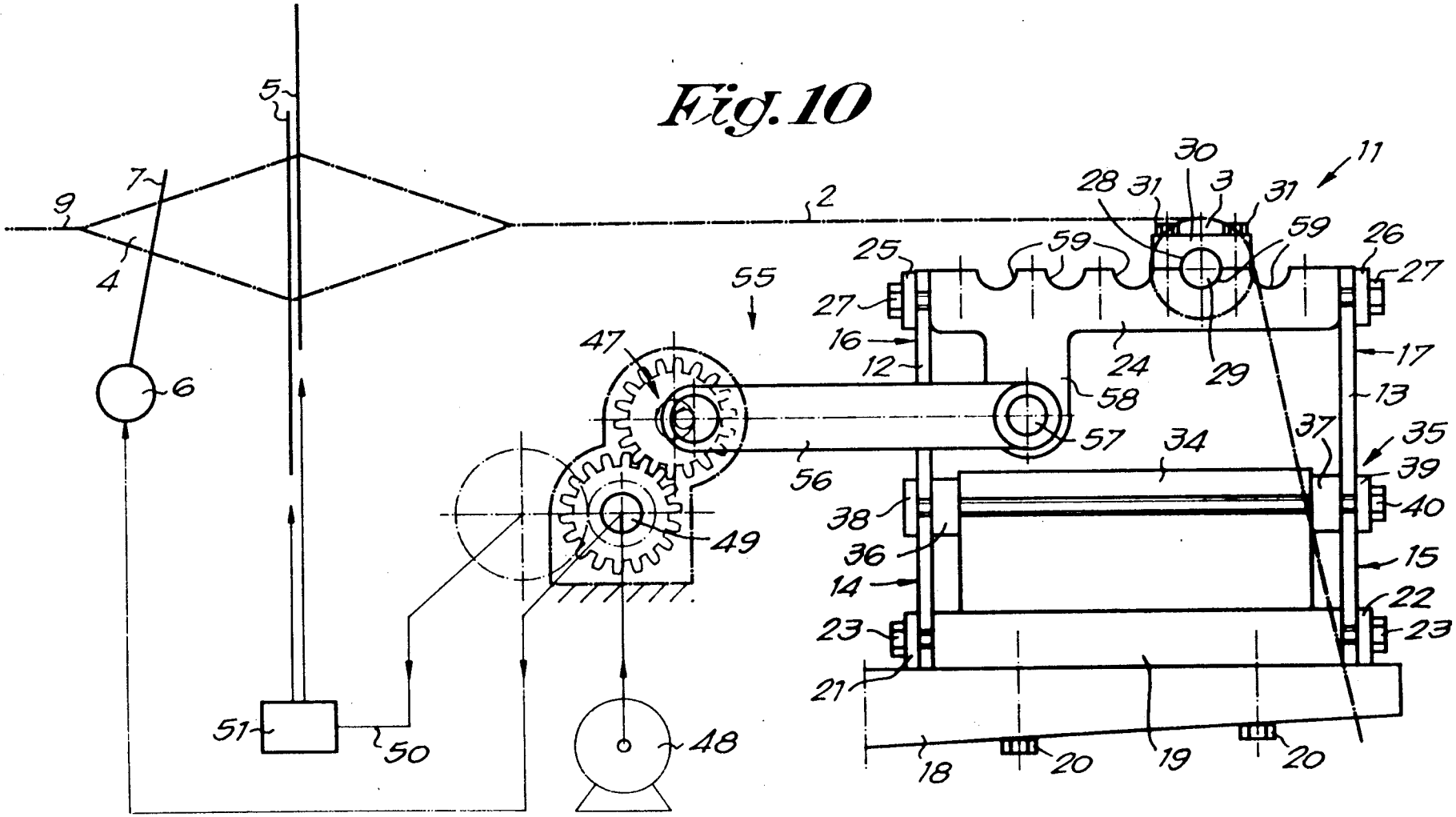

In FIG. 10 another special embodiment is shown, whereby the supports 11 on which the back rest 3 is attached are connected to a mechanism 55, which during the weaving process performs a periodical motion, preferably in correspondence with the harness drive. The mechanism 55 is hereby connected to the above-mentioned element 24. In the example shown, an eccentric 47 is used for this purpose, which is driven in a way similar as described in the example of FIG. 9, as well as an arm 56 which is driven by means of this eccentric 47 and which is connected to an arm or projection 58 on the element 24 through a hinge point 57.

The embodiment according to FIG. 10 has the advantage that the mechanism 55 is simple to construct and that only a small number of components are required. Further, the springy operation of the springs 12 and 13 recuperates energy, such that the drive couple necessary for driving the mechanism 55 remains relatively restricted.

As shown in FIG. 10, the element 24 can be provided with several seating parts 59 for attaching the back rest 3. This has the advantage that the distance between the harnesses 5 and the back rest 3 can be modified. The embodiment according to FIG. 10 also has the advantage that such a modification can be perfomed without the mechanism 55 having to be modified.

It is clear that in all previous embodiments also, an element 24 can be used which has several seating parts 59.

The present invention is in no way limited to the embodiments described by way of example and shown in the drawings; on the contrary, such a supporting mechanism for the back rest in a weaving machine can be made in various shapes and dimensions while still remaining within the scope of the invention.

We claim:

1. A supporting mechanism for a back rest in a weaving machine, comprising:

means including at least two supports for supporting respective ends of the back rest, each support comprising at least two leaf springs mounted next to each other and each leaf spring having two ends, wherein a first of said ends of one of the leaf springs is attached to a corresponding first end of a second of said leaf springs and to the weaving machine, and a second of said ends of one of the leaf springs is connected to a second of said ends of the second leaf spring, said back rest being supported by said second ends of said leaf springs.

2. A supporting mechanism as claimed in claim 1, wherein said leaf springs are mounted parallel to one another.

3. A supporting mechanism as claimed in claim 1, wherein said second ends of said leaf springs are connected to each other by means of an element in which at least one seating part is included for seating the back rest.

4. A supporting mechanism as claimed in claim 3, wherein said element includes a plurality of seating parts for the back rest.

5. A supporting mechanism as claimed in claim 1, wherein said supports are fixed to a frame of the weaving machine.

6. A supporting mechanism as claimed in claim 1, wherein said supports are mounted on a supporting means for causing a periodic motion of said supports in correspondence with a motion of a harness drive of the weaving machine during weaving.

7. A supporting mechanism as claimed in claim 1, wherein the supports are coupled to means for causing a periodic motion of said supports in correspondence with a motion of a harness drive of the weaving machine during weaving.

8. A support mechanism as claimed in claim 7, wherein said periodic motion causing means comprises an eccentric member, and an arm driven by the eccentric member and coupled to a projection on said element by means of a hinge point.

9. A supporting mechanism as claimed in claim 1, wherein said leaf springs are mounted at ends thereof exclusively by clamping.

10. A supporting mechanism as claimed in claim 1, further comprising clamping means for mounting the leaf springs by clamping, said clamping means comprising at least one support which contacts the leaf springs, clamping parts which contact sides of the leaf springs which face away from each other, and screwing means passing along the leaf springs for drawing the leaf springs toward the support as the leaf springs are clamped.

11. A supporting mechanism as claimed in claim 1, wherein said second ends are connected to each other by means of at least one element placed between the leaf springs; clamping parts; and screwing means for clamping the clamping parts against said element as the leaf springs are clamped.

12. A supporting mechanism as claimed in claim 1, further comprising adjusting means for modifying an effective length of the leaf springs.

13. A supporting mechanism as claimed in claim 12, wherein the adjusting means comprise a fixed support between the leaf springs, and clamping means adjustable in a lengthwise direction of the leaf springs for clamping the leaf springs to the fixed support at a desired height.

14. A supporting mechanism as claimed in claim 13, wherein said fixed support is less wide than a mutual distance between the leaf springs and wherein the clamping means comprise intermediate parts moveable between said fixed support and the leaf springs; clamping parts applied against sides of the leaf springs facing away from each other; and screwing means for clamping the intermediate parts and the clamping parts at a desired location around the fixed support as the leaf springs are clamped.

15. A support mechanism as claimed in claim 1, further comprising damping means including an element mounted between both leaf springs of each support for damping motion of said leaf springs.

16. A supporting mechanism as claimed in claim 15, wherein said damping element comprises a block made of synthetic material and glued between the leaf springs.

17. A supporting mechanism as claimed in claim 1, wherein the supports are substantially vertically mounted.

18. A supporting mechanism as claimed in claim 1, wherein the supports are substantially horizontally mounted.

* * * * *